US005459883A

United States Patent [19]

Garceau-Verbeck

[11] Patent Number: 5,459,883

[45] Date of Patent: Oct. 24, 1995

[54] ERGONOMIC HAND COVERING AND GRIP ENHANCER

[76] Inventor: Dorothy S. Garceau-Verbeck, 1575 N. Hickory Bldg. D, Ste. 3, Owosso, Mich. 48867

[21] Appl. No.: 209,112

[22] Filed: Mar. 9, 1994

[51] Int. Cl.[6] ..... A41D 19/00

[52] U.S. Cl. ..... 2/161.1; 2/161.2; 2/161.4

[58] Field of Search ..... 2/16, 20, 159, 2/161.1, 161.2, 161.4, 161.6, 162, 170; 473/59, 62; 482/44, 49

[56] References Cited

U.S. PATENT DOCUMENTS

| | | | |
|---|---|---|---|
| 325,968 | 9/1885 | Rawlings . | |
| 368,724 | 8/1887 | Loucks | 2/20 |
| 482,647 | 9/1892 | Obear | 2/20 |
| 975,734 | 11/1910 | Tebeau | 2/20 |
| 1,351,311 | 8/1920 | Virneburg | 2/20 |
| 1,716,221 | 6/1929 | Fernie | 2/161.1 |
| 2,154,197 | 4/1939 | Callaway | 2/159 |
| 2,270,363 | 1/1942 | Weeber . | |
| 2,547,388 | 4/1951 | Griffin | 2/20 |
| 3,269,728 | 8/1966 | Blough | 473/62 |
| 3,344,436 | 10/1967 | Stubbs | 473/59 |
| 3,369,258 | 2/1968 | Smith . | |
| 3,421,160 | 1/1969 | Domenico | 473/59 |
| 4,042,977 | 8/1977 | Antonious . | |
| 5,081,715 | 1/1992 | Mascia | 2/20 |

*Primary Examiner*—Clifford D. Crowder
*Assistant Examiner*—Michael A. Neas
*Attorney, Agent, or Firm*—Harness, Dickey & Pierce

[57] ABSTRACT

An ergonomic hand covering and grip enhancer adapted to be worn by a person to support the hand and wrist and enhance the grip that may be applied to a golf club, a tennis racket, or other article has a panel of such size and configuration as to overlie the palm and wrist of a person's hand, a restraining loop or band secured to the panel at its finger end, an anchor strap joined to the panel at its opposite end and adapted to encircle a person's wrist, and a retaining band extending from one side of the panel to the other at the finger end of the panel. An elastic tensioning band has one end secured to one side of the panel adjacent the finger end thereof and extends diagonally across the panel toward the opposite end of the panel. The opposite end of the tensioning band is secured to the panel within the confines of the anchor strap. Along one edge of the panel extends a sleeve in which is accommodated a splint.

15 Claims, 1 Drawing Sheet

9a
11
9
12
9a
10
13
2
1
3
7
8
14
15
6
5
7

9
9a
15
1
17
5
3
2
16
6
8
7

ERGONOMIC HAND COVERING AND GRIP ENHANCER

This invention relates to a hand covering and grip enhancer adapted for removable application to a person's hand and wrist to provide support for the person's hand and wrist and to enhance the grip that such person may apply to an article such as a golf club, tennis racket, or other article.

BACKGROUND OF THE INVENTION

It is common practice for a worker or an athlete to wear a glove on one or both hands to provide support for the hands and wrists and to enhance the grip that may be applied to an article such as a golf club, tennis racket, or other equipment. It is not uncommon for typists, food servers, and others engaged in occupations that stress the hand and wrist to make use of a glove-like support or hand covering. One currently available form of glove completely encloses the hand, including the thumb and four fingers, whereas another form of glove accommodates the palm and back of the hand and the first joint of the thumb and four fingers. In either case, the palm and back of the hand are poorly ventilated, if at all, with the result that the material from which the glove is made becomes saturated with perspiration, especially on hot, humid days.

There are other devices, not properly called gloves, which are used by persons to apply compressive force on arms or wrists, but these devices do not enhance the person's grip on an article.

Although some presently available gloves do enhance the grip with which a person may hold an article, such gloves provide little, if any, support for the person's hand or wrist. Neither do they provide much, if any, cushioning of the palm of the hand.

A grip enhancer and hand covering constructed according to the invention provides adequate coverage of the palm of a person's hand to ensure protection for the palm and provide enhancement of the grip, provides adequate ventilation for a person's hand, thereby minimizing the positioning changes and consequent loss of gripping security to which the device is subjected and provides continuous, yieldable support for the person's hand and wrist.

SUMMARY OF THE INVENTION

A grip enhancer and hand covering constructed according to the preferred embodiment of the invention has a panel formed of suitable pliable, relatively inelastic material and of such size as to overlie the palm and wrist of a person's hand. That end of the panel adjacent the wrist has secured thereto an elastic anchor strap which may encircle the user's wrist and the adjacent portion of the forearm. The opposite end of the panel has one or more elastic restraining loops adapted to accommodate one or more fingers of the person's hand and thereby restrain bunching of the panel in the wearer's palm.

A retaining band extends from one edge of the panel to its opposite edge and is secured to the opposite edges of the panel in a position to overlie the back of the person's hand at the zone of the knuckles, thereby securely, but yieldably, maintaining the panel in overlying relation with the palm of the hand and enhancing the grip with which the person may hold an article.

An elastic tensioning band is secured at one of its ends to one edge of the panel in a position between the retaining band and the anchor strap and adjacent the little finger of the person's hand on which the enhancer is applied. The tensioning band extends diagonally across the panel toward the opposite edge thereof and is secured thereto at a zone within the confines of the anchor strap.

That portion of the panel which overlies the palm of a person's hand may be of multiple thicknesses of material and, if desired, a cushioning pad may be adhered to the panel.

To assist in restraining lateral movement of the wrist of a person the panel may include a sleeve extending along the length of the panel for the accommodation of a stiff splint.

THE DRAWINGS

A grip enhancer and hand covering constructed in accordance with the presently preferred embodiment of the invention is illustrated in the accompanying drawings, wherein:

FIG. 1 is a plan view of the back of a person's hand to which the grip enhancer is applied, the hand being shown in phantom; and FIG. 2 is a plan view of the palm of the hand to which the grip enhancer is applied.

DETAILED DESCRIPTION

Figure 1:
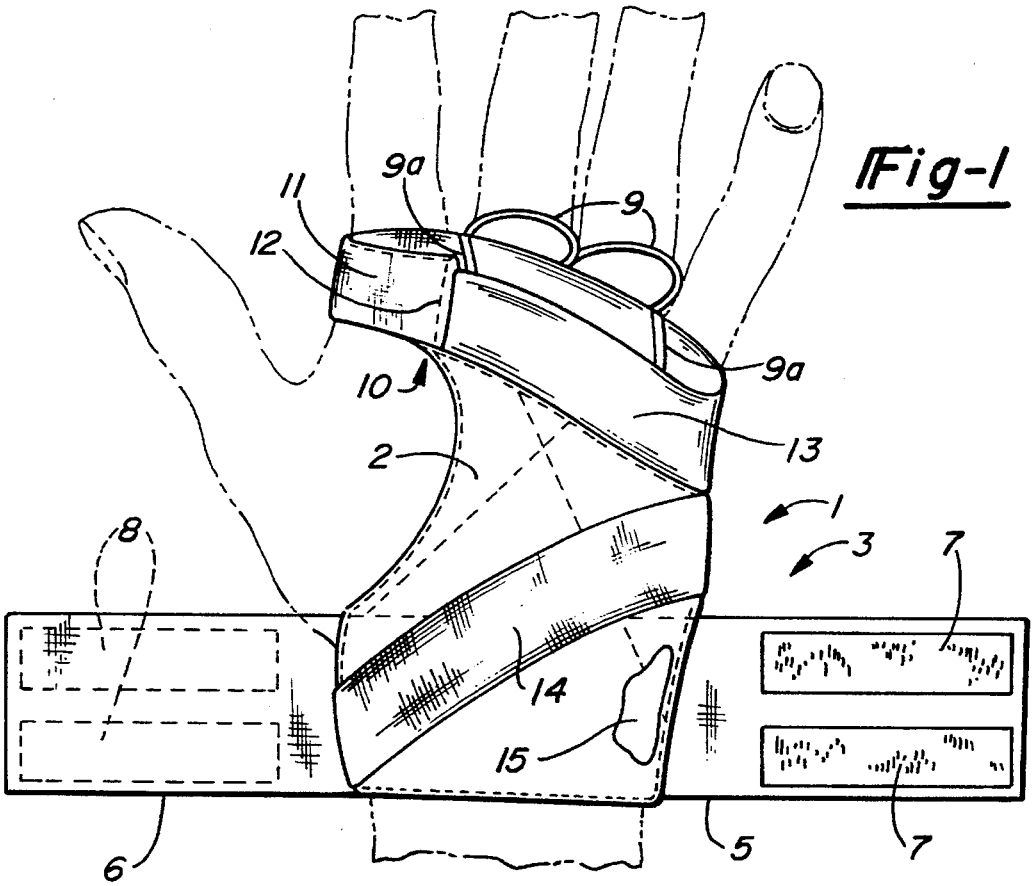
Figure 2:
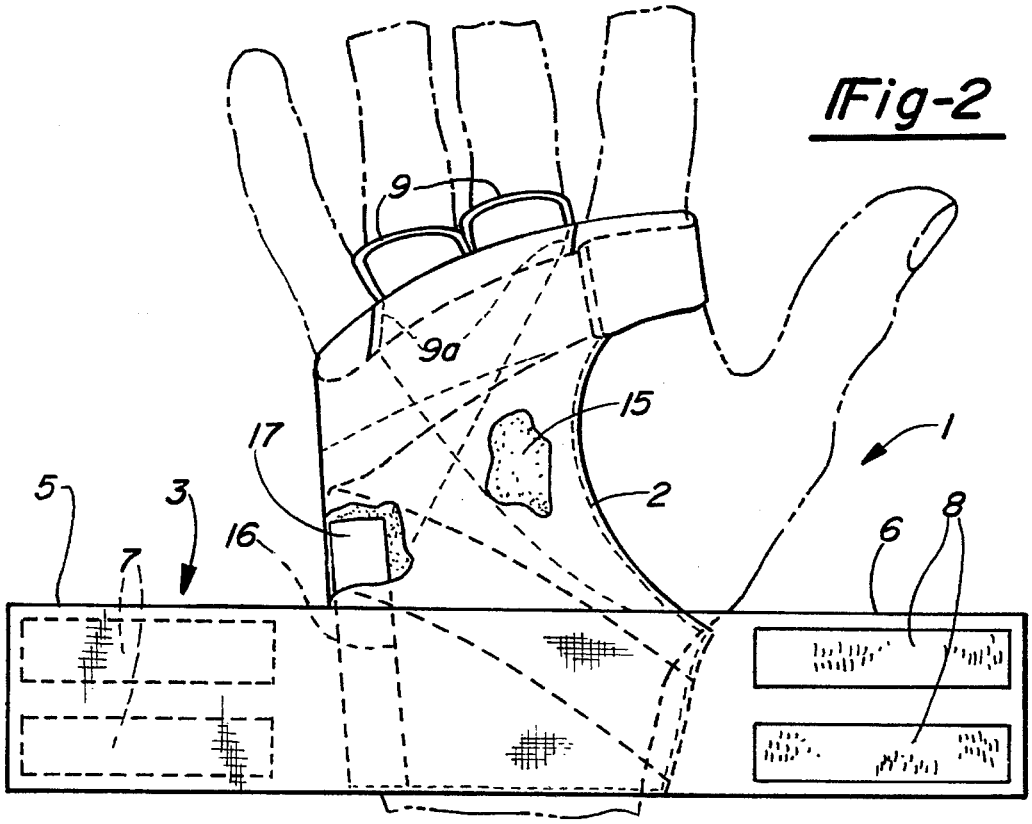

A grip enhancer and hand covering constructed in accordance with the disclosed embodiment is designated generally by the reference character 1 and comprises a panel 2 formed of suitable material such as fabric, leather, or a combination of fabric and leather-like or rubbery material. The material from which the panel is formed also may be oil and acid resistent. The panel is of such width as to span the width of an adult person's hand and cover the outside edge of the hand. The panel also is of such length as to extend from the juncture of the person's palm and fingers in a direction toward the wrist and beyond the heel of the hand. The panel, therefore, substantially covers the palm and inside surface of a person's hand and wrist.

To that end of the panel adapted to overlie the wrist is stitched or otherwise suitably secured an elastic anchor strap 3 of such length as to encircle the user's wrist. The strap may be formed as a closed loop of material, but it preferably comprises an elongate strap 3 having a central section 4 that is stitched or otherwise secured to the panel 2. Its opposite end sections 5 and 6 are separable and provided with cooperable fastening means 7 and 8 so as releasably to secure the strap to wrist in encircling relation therewith. Preferably, the fastening means 7, 8 are adjustable relative to one another to enable the strap to accommodate wrists of different size or apply varying degrees of force on the wrist. The strap preferably is three to six inches in width and a suitable form of fastener comprises the cooperating hooks and loops of a Velcro fastener.

Stitched or otherwise suitably secured to the opposite end of the panel 2 is at least one restraining loop 9. In the disclosed embodiment there are two loops 9 each of which is of such size as to accommodate one finger. Each loop preferably is formed of elastic material to facilitate the application and removal of the grip enhancer to the person's hand.

At one edge of the panel 2 and adjacent the finger end thereof is a retaining band 10 comprising an extension 11 of the panel 2 which is adapted to wrap partially around the person's index finger. The extension has a free end 12 which is stitched or otherwise suitably secured to one end of an elastic strip 13 that is adapted to overlie the back of a person's hand. The strip extends toward and is stitched or otherwise suitably secured at its opposite end to the panel 2. The extension 11 and the strip 13 together form the elastic retaining band 10 and span the distance from one side of the panel to the other in a position to overlie the back of a person's hand adjacent the knuckles. The retaining band is of such length that it is elastically stretched when the grip enhancer is applied to a person's hand, thereby securely retaining the finger end of the panel 2 in place.

Two additional restraining bands 9*a* are stitched or otherwise suitably secured at their opposite ends to the panel 2 and the strap 13, respectively, in a position to lie between two adjacent fingers of a person's hand. These bands perform the same function as the bands 9. In those instances in which the device 1 is worn by a machine operator, the bands 9 may be removed so as to avoid any likelihood that they may catch on some part of the machine.

An elastic tensioning band 14 is secured at one of its ends to one side of the panel 2 between the retaining band 10 and the strap 3 and at a zone adjacent the retaining band. The tensioning band 14 extends diagonally across the panel and has its opposite end secured to the opposite side of the panel at a zone within the confines of the anchor strap 3. The band 14 is taut so as to lie flat against the panel 2 even when the grip enhancer is not applied to a person's hand.

To apply the grip enhancer to the hand of a person the end portions 5 and 6 of the anchor strap are separated from one another, the hand is inserted between the panel 2, the retaining band 10, and the tensioning band 14, thereby elastically stressing the bands 10 and 14. The ring and middle fingers are thrust through the loops 9, with the bands 9*a* between adjacent fingers, and the anchor strap secured in snugly encircling relation about the wrist. In this position the panel 2 confronts the person's palm and the bands 10 and 14 overlie the back of the hand.

In the disclosed embodiment the palm, the heel, and the outside edge of the person's hand are covered. The material from which the grip enhancer is made thus makes it possible for the person to grip a golf club, a racket, a bat, or other article without the application of substantial force, and the grip will be enhanced by the type of material from which the panel is made. In addition, the panel will protect the person's skin against chaffing by contact with the gripped article and the consequent raising of blisters.

The panel 2 may be formed of one layer of material or a plurality of overlying layers. If desired, a pad 15 of shock absorbing, cushioning material may be interposed between adjacent layers. Further, the layer of the panel that is adapted to engage an article may be provided with a nubby surface to enhance the gripping characteristics of the panel.

Although the anchor strap 3 is elastic, the securing of the central portion 4 of the strap to the relatively inelastic panel renders the central portion virtually inelastic. Consequently, the stretching of the tensioning band 14 as a result of its application to the hand enables it to exert a force on the person's hand tending to maintain the hand in a position in prolongation of the forearm. That is, the tendency of the wrist to bend is resisted and the hand is supported, thereby lessening fatigue and the possibility of over-stressing the hand and wrist.

In some instances it may be desirable to minimize bending of the wrist laterally. This may be accomplished by the provision of a scabbard-like sleeve 16 along that side of the panel that will be located adjacent the outside edge of a person's hand. A transversely curved, stiff splint 17 formed of suitable plastic or metal may be fitted into the sleeve. The sleeve and the splint are of such length as to overlie part of the hand, the wrist, and part of the forearm, thereby inhibiting lateral bending of the wrist.

A grip enhancer and hand covering constructed according to the invention may be used by persons engaging in athletic and other activities such as rowing, paddling, raking, sweeping, batting, typing, or indeed in any activity wherein it is desirable to enhance the grip a person may exert on an object or provide support for a person's hand and wrist.

The disclosed embodiment is representative of a presently preferred form of the invention, but is intended to be illustrative rather than definitive thereof. The invention is defined in the claims.

I claim:

1. A covering for removable application to a person's hand and wrist comprising a panel of such width and length as to overlie the palm and wrist of the person's hand and extend from one side of the palm to the other and from the person's wrist to the juncture of the person's palm and fingers; at least one restraining member joined to said panel adjacent one end thereof in a position to engage the person's hand and restrain movement of said one end of said panel in a direction toward the wrist; an elastic retaininq band secured at its opposite ends to said panel adjacent said one end of said panel and extending from said one edge of said panel to the other side edge of said panel in a position to overlie the back of a person's hand adjacent the knuckles; an elastic anchor strap secured to said panel at its opposite end for encircling the person's wrist; an elastic tensioning band joined to and extending diagonally from said other side edge of said panel adjacent said retaining band toward the opposite edge of said panel and in a position to overlie the back of the person's hand; and means securing said tensioning band at its opposite end to said panel at a zone within the confines of said anchor strap, said panel being relatively inelastic compared to said elastic retaining band, said anchor strap, and said tensioning band.

2. The covering according to claim 1 wherein said restraining member comprises at least one loop for accommodating at least one finger.

3. The covering according to claim 2 wherein said restraining member comprises a plurality of said loops, each of which is adapted to accommodate a different finger.

4. The covering according to claim 2 wherein said loop is elastic.

5. The covering according to claim 1 wherein said restraining member comprises at least one band for accommodation between two adjacent fingers.

6. The covering according to claim 1 including separable fastening means carried by said anchor strap for enabling said strap to be applied to and removed from the person's wrist.

7. The covering according to claim 6 wherein said fastening means is adjustable.

8. The covering according to claim 1 wherein said retaining band is composed of an extension of said panel having a free end to which one end of an elastic strap is secured, said elastic strap having its opposite end secured to said panel.

9. The covering according to claim 1 wherein said panel is composed of a plurality of overlying layers of pliable material.

10. The covering according to claim 1 wherein said panel comprises overlying layers of pliable material and a pad of pliable material between said layers.

11. The covering according to claim 1 wherein said anchor strap is relatively elastic and said panel is relatively inelastic, that portion of said anchor strap which is secured to said panel being rendered relatively inelastic by said panel.

12. The covering according to claim 1 wherein said panel has a sleeve extending along one edge thereof and an elongate splint accommodated in said sleeve.

13. The cover according to claim 12 wherein said split is transversely curved.

14. The cover according to claim 12 wherein said splint is of such length as to span the wrist and overlie a portion of the hand and forearm adjacent the wrist.

15. A covering for removable application to a person's hand and wrist comprising a panel of such width and length as to overlie the palm and wrist of the person's hand and extend from one side of the palm to the other and from the person's wrist to the juncture of the person's palm and fingers; at least one restraining member joined to said panel adjacent one end thereof in a position to engage the person's hand and restrain movement of said one end of said panel in a direction toward the wrist; a retaining band adjacent one end of said panel and extending from one edge of said panel to the other in a position to overlie the back of a person's hand adjacent the knuckles; an anchor strap secured to said panel at its opposite end for encircling the person's wrist; an elastic tensioning band joined to and extending diagonally from one edge of said panel adjacent said one end thereof toward the opposite edge of said panel and in a position to overlie the back of the person's hand; and means securing said tensioning band at its opposite end to said panel at a zone within the confines of said anchor strap, said anchor strap being relatively elastic and said panel being relatively inelastic, that portion of said anchor strap which is secured to said panel being rendered relatively inelastic by said panel.

* * * * *